US008740753B2

(12) United States Patent
Olson et al.

(10) Patent No.: US 8,740,753 B2
(45) Date of Patent: Jun. 3, 2014

(54) ADJUSTABLE RESISTANCE BASED EXERCISE APPARATUS

(75) Inventors: Michael Olson, Logan, UT (US); William Dalebout, North Logan, UT (US); Steven M. Shorten, Logan, UT (US)

(73) Assignee: ICON IP, Inc., Logan, UT (US)

( * ) Notice: Subject to any disclaimer, the term of this patent is extended or adjusted under 35 U.S.C. 154(b) by 26 days.

(21) Appl. No.: 13/186,292

(22) Filed: Jul. 19, 2011

(65) Prior Publication Data

US 2013/0023389 A1 Jan. 24, 2013

(51) Int. Cl.
*A63B 71/00* (2006.01)

(52) U.S. Cl.
USPC ..... 482/51; 482/121; 482/136

(58) Field of Classification Search
USPC ..... 482/51, 92, 100, 114–122, 135–137
See application file for complete search history.

(56) References Cited

U.S. PATENT DOCUMENTS

| | | | | |
|---|---|---|---|---|
| 5,026,049 | A | 6/1991 | Goodman | |
| 5,147,266 | A | 9/1992 | Ricard | |
| 5,184,994 | A * | 2/1993 | Morris et al. | 482/129 |
| 5,407,414 | A * | 4/1995 | Bass | 482/129 |
| 5,720,702 | A * | 2/1998 | Lee | 482/129 |
| 5,755,646 | A * | 5/1998 | Chu | 482/118 |
| 5,800,323 | A * | 9/1998 | Ansel | 482/129 |
| 6,666,796 | B1 * | 12/2003 | MacCready, Jr. | 482/51 |
| 6,689,025 | B2 * | 2/2004 | Emick | 482/123 |
| 7,250,022 | B2 | 7/2007 | Dalebout et al. | |
| 7,361,127 | B2 | 4/2008 | Tremayne | |
| 7,482,050 | B2 | 1/2009 | Olson | |
| 7,569,005 | B2 * | 8/2009 | Geeting | 482/121 |
| 7,614,984 | B1 | 11/2009 | Krull | |
| 7,625,321 | B2 | 12/2009 | Simonson et al. | |
| 7,780,583 | B2 * | 8/2010 | Brown | 482/112 |
| 7,833,141 | B2 | 11/2010 | Kulka | |
| 7,837,598 | B1 * | 11/2010 | Boozel, Jr. | 482/38 |
| 2008/0020912 | A1 | 1/2008 | Dalebout et al. | |
| 2009/0227432 | A1 | 9/2009 | Pacheco | |
| 2010/0009818 | A1 * | 1/2010 | Simonson et al. | 482/97 |

* cited by examiner

*Primary Examiner* — Glenn Richman
(74) *Attorney, Agent, or Firm* — Holland & Hart LLP

(57) ABSTRACT

An exercise apparatus includes a frame, a resistance lever pivotably attached to the frame, a resistance engagement member moveably attached to the resistance lever, the resistance engagement member being positionable at a plurality of attachment points on the resistance lever, and a resistance element disposed adjacent to the resistance engagement member. The resistance element includes a deflection member having a first end and a second end, a first anchor attached to and positionally fixing the first end of the deflection member, and a second anchor attached to and positionally fixing the second end of the deflection member. When a force is input to the resistance lever, the resistance lever pivots about the pivot point and the resistance engagement member transversely engages the deflection member. The apparent resistance provided by the resistance element is adjusted by positionally adjusting the resistance engagement member along the attachment points relative to the anchors.

20 Claims, 12 Drawing Sheets

ADJUSTABLE RESISTANCE BASED EXERCISE APPARATUS

BACKGROUND

Exercise apparatuses commonly employ a weight stack actuated by a cable which is pulled by users of the apparatus. Recently, resistive elastic members, such as bands or plates, have been incorporated into exercise equipment to provide motion resistance. Specifically, resistive elastic members have gained increased popularity due to their ability to provide substantially consistent tension throughout the desired range of motion and generate an increased use of stabilizer muscles to oppose the substantially consistent tension.

While the use of resistive elastic members provides many benefits, traditional apparatus configurations can present limitations affecting the usefulness of the exercise apparatus. For example, the range of exercises which may be performed with certain cable actuated apparatuses is sometimes limited by the position and orientation of the apparatus itself. Particularly, with the added range of motion and resistance offered by the use of resistive elastic members, such as bands and plates, consumer needs and considerations are often at odds. Additionally, traditional uses of resistive elastic members have been limited to substantially linear axial motions that are opposed by the force of the elastic member material.

One type of resistance based apparatus is disclosed in U.S. Pat. No. 7,250,022 assigned to ICON IP, INC. In this patent, an exercise machine includes a number of resilient elongate members oriented horizontally such that the intermediate portion of the elongate members engage a fulcrum of the exercise machine. A user adjusts the amount or resistance provided by capturing different combinations and numbers of resilient elongate members. An alternative resistance based apparatus is also disclosed in U.S. Pat. No. 6,689,025 issued to Daniel W. Emick. In this patent, an exercise machine is described that uses a hand crank to selectively modify the effective length of rubber tubing that is used for resistance training by axially extending the rubber tubing after the length has been modified to a desired length.

SUMMARY

In one aspect of the invention, an exercise apparatus includes a frame, a resistance lever pivotably attached to the frame, a resistance engagement member moveably attached to the resistance lever, and a resistance element disposed adjacent to the resistance engagement member.

Another aspect of the invention that may include any combination of these aspects includes the resistance engagement member positionable at a plurality of attachment points on the resistance lever.

Yet another aspect of the invention that may include any combination of these aspects includes the resistance element being a deflection member having a first end and a second end, a first anchor attached to and positionally fixing the first end of the deflection member, and a second anchor attached to and positionally fixing the second end of the deflection member.

Yet another aspect of the invention that may include any combination of these aspects is configured such that when a force is input to the resistance lever, the resistance lever pivots about the pivot point and the resistance engagement member transversely engages the deflection member.

Yet another aspect of the invention that may include any combination of these aspects is configured such that the apparent resistance provided by the resistance element is adjusted by positionally adjusting the resistance engagement member along the attachment points relative to the first and second anchors.

Yet another aspect of the invention that may include any combination of these aspects includes a frame having a base and at least one vertical support member attached to the base.

Yet another aspect of the invention that may include any combination of these aspects includes the first anchor and the second anchor each connected to the at least one vertical support member.

Yet another aspect of the invention that may include any combination of these aspects includes a base, at least one vertical support member attached to the base, and a pivot assembly attached to the at least one vertical support member.

Yet another aspect of the invention that may include any combination of these aspects includes the first anchor attached to the pivot assembly and the second anchor attached to the at least one vertical support member.

Yet another aspect of the invention that may include any combination of these aspects includes a user engagement member disposed on the resistance lever.

Yet another aspect of the invention that may include any combination of these aspects includes the plurality of attachment points being configured to selectively position the resistance engagement member between the first anchor and a midpoint of the deflection member.

Yet another aspect of the invention that may include any combination of these aspects includes an input actuation member connected to the resistance lever.

Yet another aspect of the invention that may include any combination of these aspects includes an input lever arm having a first end and a second end, wherein a first end of the input lever arm is connected to the resistance lever, and a user engagement member disposed on the second end of the input lever arm.

Yet another aspect of the invention that may include any combination of these aspects includes an input actuation member in the form of a cable.

Yet another aspect of the invention that may include any combination of these aspects includes an elastomer deflection member.

Yet another aspect of the invention that may include any combination of these aspects includes the deflection member in the form of one of a latex rubber, a natural rubber, a styrene-butadiene rubber, an isoprene rubber, a butadiene rubber, an ethylene propylene rubber, a butyl rubber, a chloroprene rubber, a nitrile rubber, or a silicone rubber.

Yet another aspect of the invention that may include any combination of these aspects includes a resistance engagement member including a selection pin.

Yet another aspect of the invention that may include any combination of these aspects includes the resistance lever defining a plurality of orifices to receive the selection pin and positionally secure the resistance engagement member on the resistance lever relative to the first and second anchor.

Yet another aspect of the invention that may include any combination of these aspects includes the resistance engagement member having at least one abutment bushing disposed adjacent to the deflection member.

Yet another aspect of the invention that may include any combination of these aspects includes the resistance engagement member including a first abutment bushing and a second abutment bushing, wherein the deflection member is disposed between the first abutment bushing and second abutment bushing.

Yet another aspect of the invention that may include any combination of these aspects includes the resistance engagement member being configured to have at least a first position and a second position on the resistance lever relative to the first and second anchors, wherein the resistance engagement member positioned in the first position deflects the deflection member a first amount in a direction substantially transverse to an axis of the deflection member in response to an angular rotation of the resistance lever, and wherein the adjustable engagement member positioned in the second position deflects the deflection member a second amount in a direction substantially transverse to an axis of the deflection member in response to the angular rotation of the resistance lever.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

Figure 1:
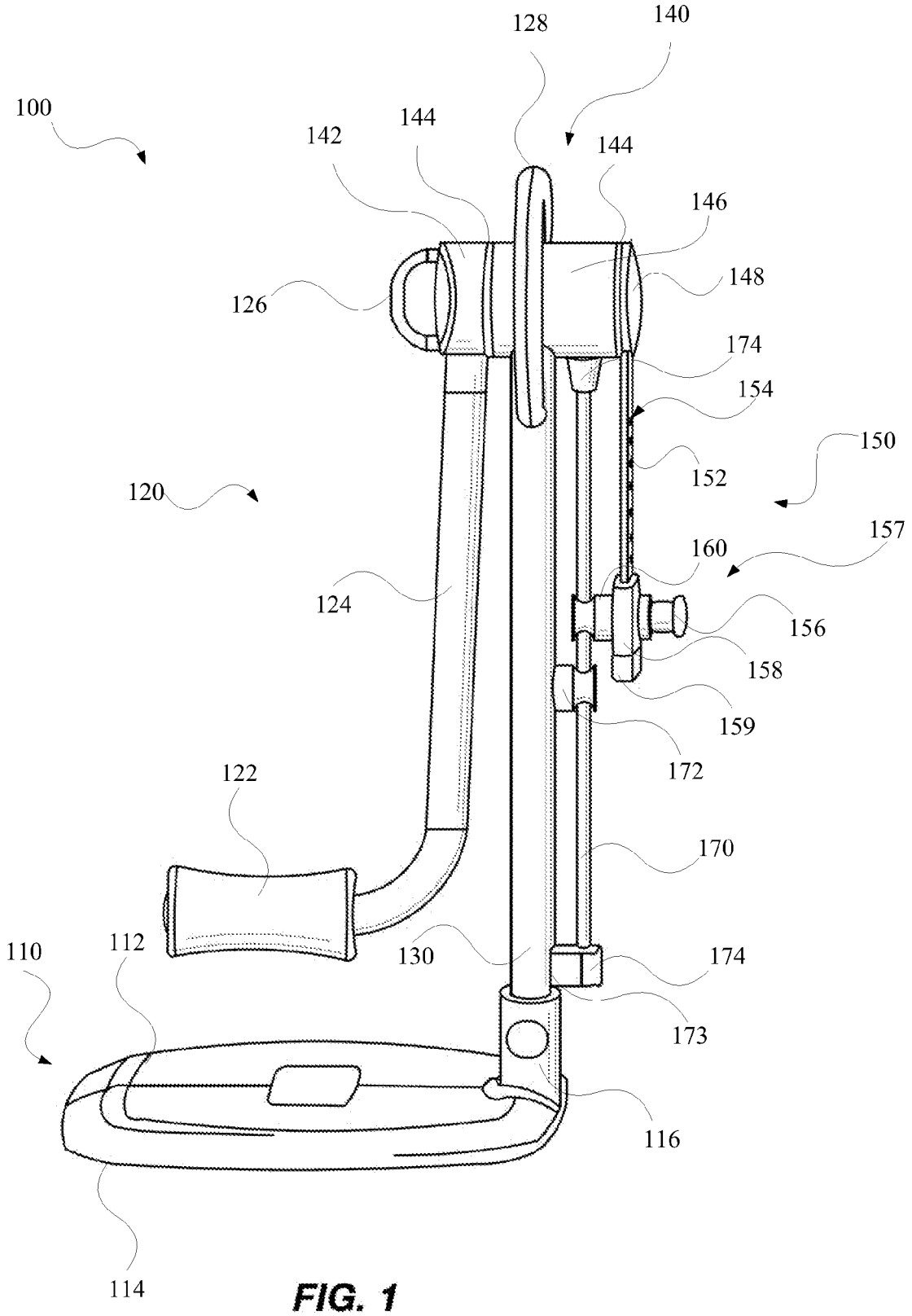
FIG. 1 is a side profile view of a resistance based exercise apparatus, according to one embodiment.
Figure 2:
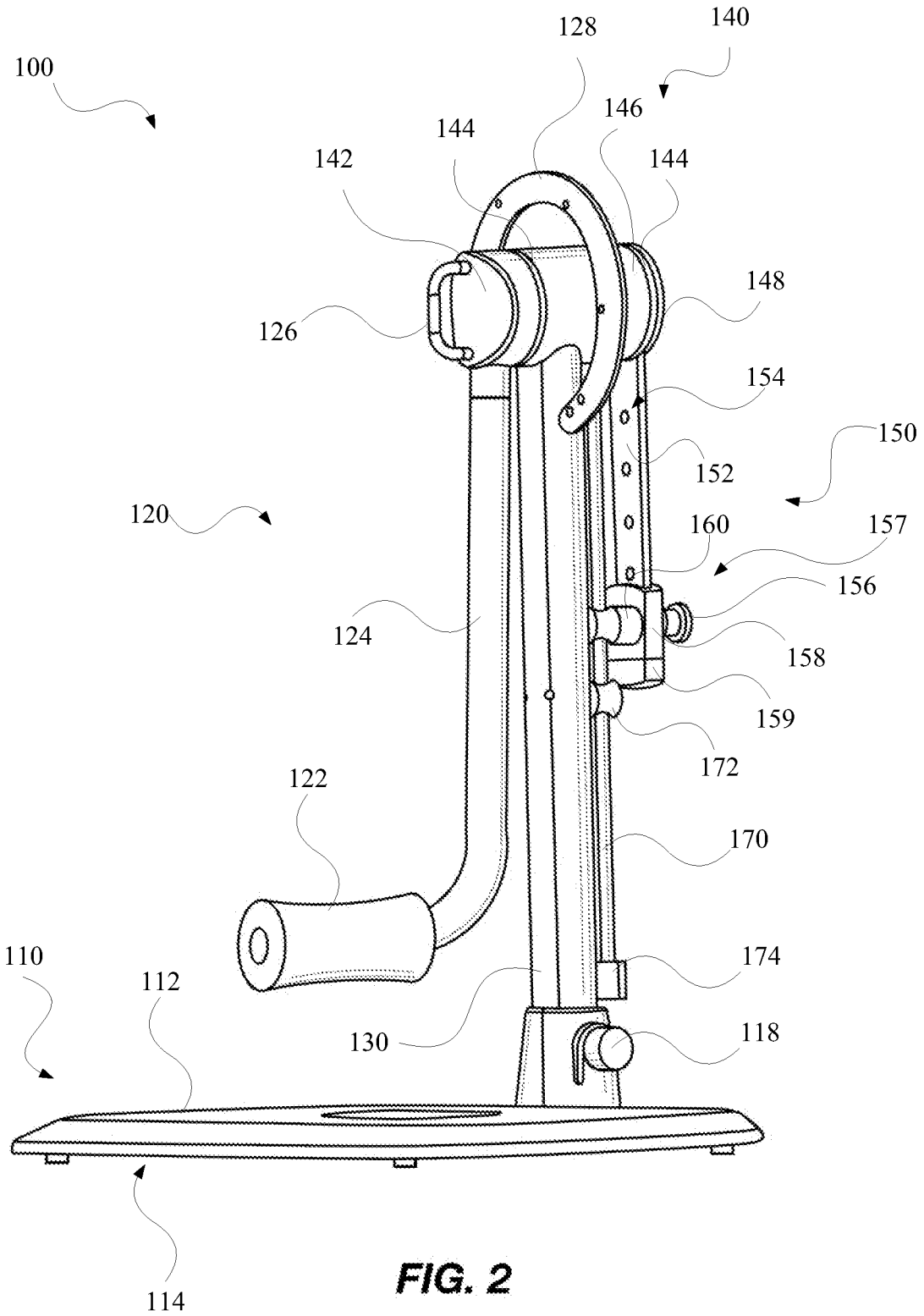
FIG. 2 is a front perspective view of a resistance based exercise apparatus, according to one embodiment.
Figure 3:
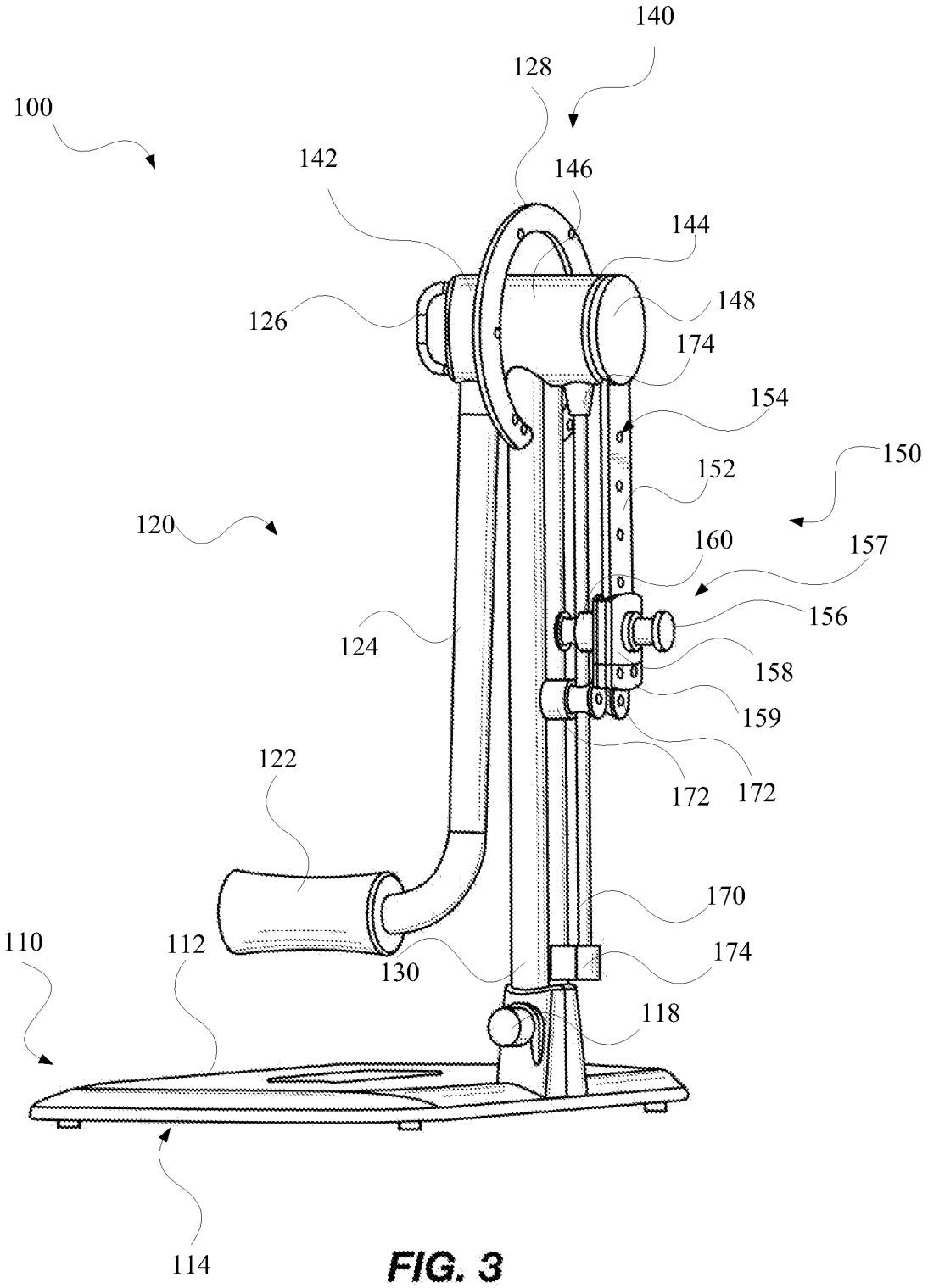
FIG. 3 is a back perspective view of a resistance based exercise apparatus, according to one embodiment.
Figure 4:
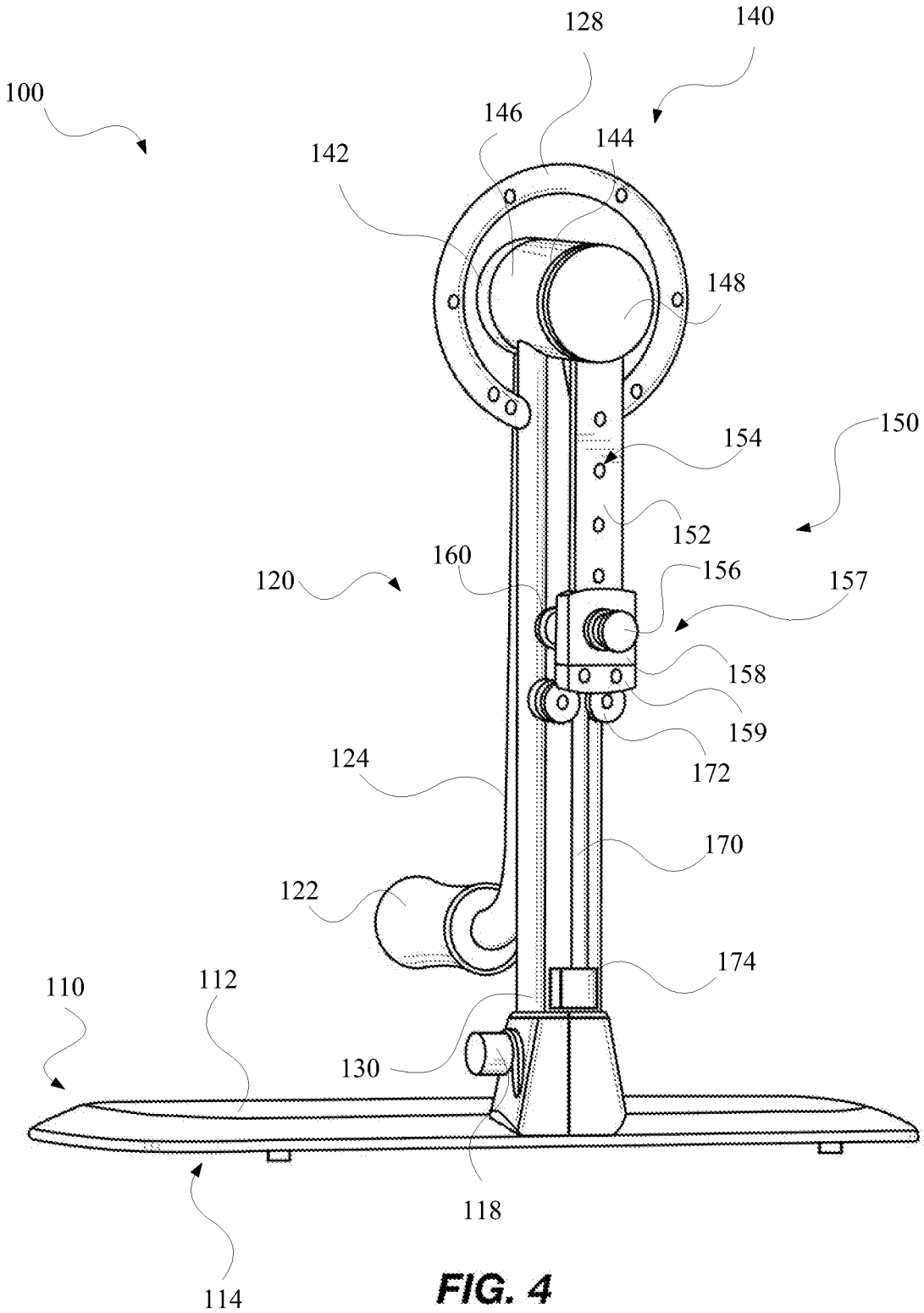
FIG. 4 is a back view of a resistance based exercise apparatus, according to one embodiment.

With reference to FIGS. 1-5, a resistance based exercise system 100 includes a frame in the form of a base 110, a vertical support structure 130, and a pivot assembly 140. As illustrated in FIGS. 1-5, the resistance based exercise system 100 also includes an input actuation member 120 and a resistance system 150 pivotably connected to the vertical support structure 130 through the pivot assembly 140. The base 110 serves as a support structure and engages the floor or other surface upon which the system is positioned and upon which the desired exercises will take place. Consequently, as illustrated, the base 110 includes a platform 112 that provides a substantially flat surface for performing a plurality of exercises while maintaining the stabilizing footprint of the base. As shown, during use, the weight of the user may be applied to the platform 112 and distributed across the platform and bottom surface of the base 114 to enhance the effective footprint of the base 110, thereby stabilizing the system 100 during operation. The platform 112 may include any number of non-slip surfaces or friction enhancing materials to aid in the stabilization of the user and prevent unintentional motion while exercising. Furthermore, the platform 112 may be made of any number of durable materials including, but in no way limited to, a plastic, a metal, a composite, and the like. In one configuration, the base 110 is formed of a structural plastic in a substantially rectangular shape to maximize footprint size and stability in multiple directions while facilitating foot placement and support of the user. Alternatively, the base 110 may assume any number of desired configurations and shapes to provide stability, storability, and/or room placement.

Figure 5:
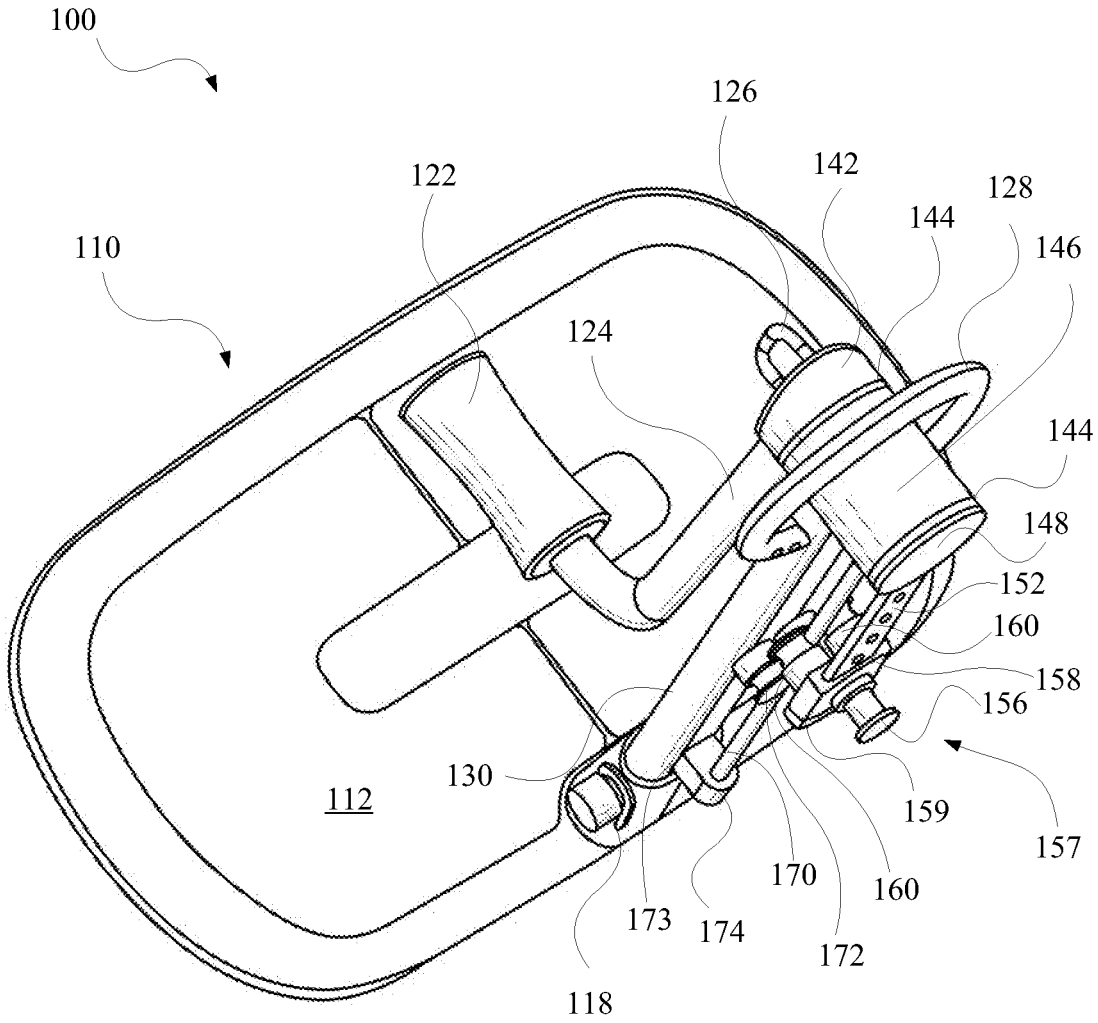
FIG. 5 is a top perspective view of a resistance based exercise apparatus, according to one embodiment.

The at least one vertically oriented support member 130 is connected to the base 110 through a vertically oriented base extension 116. As shown, forces applied to the base extension 116 and vertical support structure 130 during operation are translated down to and dispersed throughout the base 110. The base extension 116 is contiguously formed or fixedly attached to the base structure and protrudes in a vertical direction. The base structure 110 may be connected to the base extension via any number of joining techniques or intermediate members including, but in no way limited to a weld, fasteners, press fit, adhesives, and in some configurations may be unitarily formed with the base 110. According to the illustrated embodiment, the base extension 116 protrudes vertically to provide a mounting location for the vertical support 130 while opposing any forces imparted on the system by operation of the apparatus 100. As shown in the Figures, one or more vertical support mounting members 118 may be used to couple the base extension 116 and the vertical support member 130. The connecting of the vertical support member 130 to the base extension via the one or more mounting members 118 may be fixed or, alternatively in a telescoping configuration (not shown) between the base extension 116 and the vertical support member 130, may be adjustable to vary the effective height of the resistance based exercise system 100 according to the user's height and preferences. Additionally, as illustrated in FIGS. 1 and 5, the vertical support member 130 or base 110 may include a bottom mounting point 173 for attaching a resistance system, as will be discussed in further detail below, with reference to FIGS. 6 and 7.

Continuing with the embodiment illustrated in FIGS. 1-5, the vertical support member 130 extends upwardly and includes a pivot assembly 140. As illustrated in FIGS. 1-5, a support handle 128 may be formed around or near the pivot assembly 140 to provide an engagement point for a user to enhance their stability during operation. As shown, the support handle 128 may be a curved cylindrical member coupled to the vertical support member 130 such that a user may grasp the support handle from any number of directions.

As illustrated, the pivot assembly is disposed on the upper end of the vertical support 130, but may be located elsewhere. According to the present embodiment, the pivot assembly 140 includes a pivot housing 146 that defines a cavity or hole. The area within the pivot housing 146 facilitates the rotation of an input actuation member 120 and the translation of that rotation to a resistance system 150, as will be described in further detail below with reference to FIGS. 8 and 9. The pivot housing is sized to allow the rotation of the input actuation member 120 and the resistance lever 152. According to the embodiment illustrated in FIGS. 1-5, the actuation member 120 and the resistance lever arm 152 of the resistance system 150 are connected within the pivot assembly 140 such that a rotation of the actuation member 120 is translated to, and causes motion of, the resistance lever arm 152. Specifically, the actuation member 120 and the resistance lever arm 152 of the resistance system 150 can be connected concentrically within the pivot assembly via a sleeve, an abutment, or an intermediate connecting member.

As shown, a number of bushings 144 may be incorporated into the present pivot assembly 140 between the pivot housing 146, the resistance lever arm 152, and/or the actuation member 120. The bushings 144 decrease friction between the pivot housing 146, the resistance lever arm 152, and the actuation member 120 such that the moving portions of the resistance based exercise system 100 may freely rotate within the pivot housing without substantial friction imposed resistance.

According to the illustrated embodiment, the actuation member 120 is disposed on a first side of the resistance based exercise system 100 opposite the resistance system 150. The actuation member 120 is disposed above the base 110 and is pivotably attached to the pivot assembly 140 such that the actuation member 120 pivots about the pivot assembly 140. Particularly, according to one embodiment, the actuation member 120 includes an actuation pivot cap 142 concentrically positioned adjacent to the pivot housing 146 and a bushing 144. On the end of the actuation pivot cap 142 is a handle 126 for adding stability to a user. The actuation pivot cap 142 may include an internal member (not shown) that passes through the pivot housing 146 to join the actuation pivot cap 142 to the corresponding lever cap 148 such that the rotation of the respective caps is proportionally coordinated.

The actuation member 120 includes a lever arm 124 that extends from the actuation pivot cap 142 toward the base 100, terminating with user engagement member 122. According to the illustrated embodiment, the lever arm, when in a disengaged state, is oriented straight down from the actuation pivot cap 142, parallel to the vertical support 130 toward the base 110. While a vertical starting orientation is illustrated in FIGS. 1-5, any number of fixed or variable starting orientations may be accomplished by modifying the rotational orientation of the actuation pivot cap 142 relative to the corresponding lever cap 148. Furthermore, the starting orientation may be a pre-tensioned position. As shown, the lever arm 124 is fixedly connected to the actuation pivot cap such that any rotation of the lever arm 124 is transferred to the actuation pivot cap 142 and subsequently to the resistance lever arm 152 of the resistance system 150. The lever arm 124 may be actuated by the input of a force by a user to the user engagement member 122. According to the embodiment illustrated in FIGS. 1-5, the user engagement member 122 is disposed on the end of the lever arm 124 and is oriented substantially perpendicular to the lever arm 124. The user engagement member may be padded or unpadded. The padded embodiment illustrated in FIGS. 1-5 may include, but is not limited to a foam member.

Figure 6:
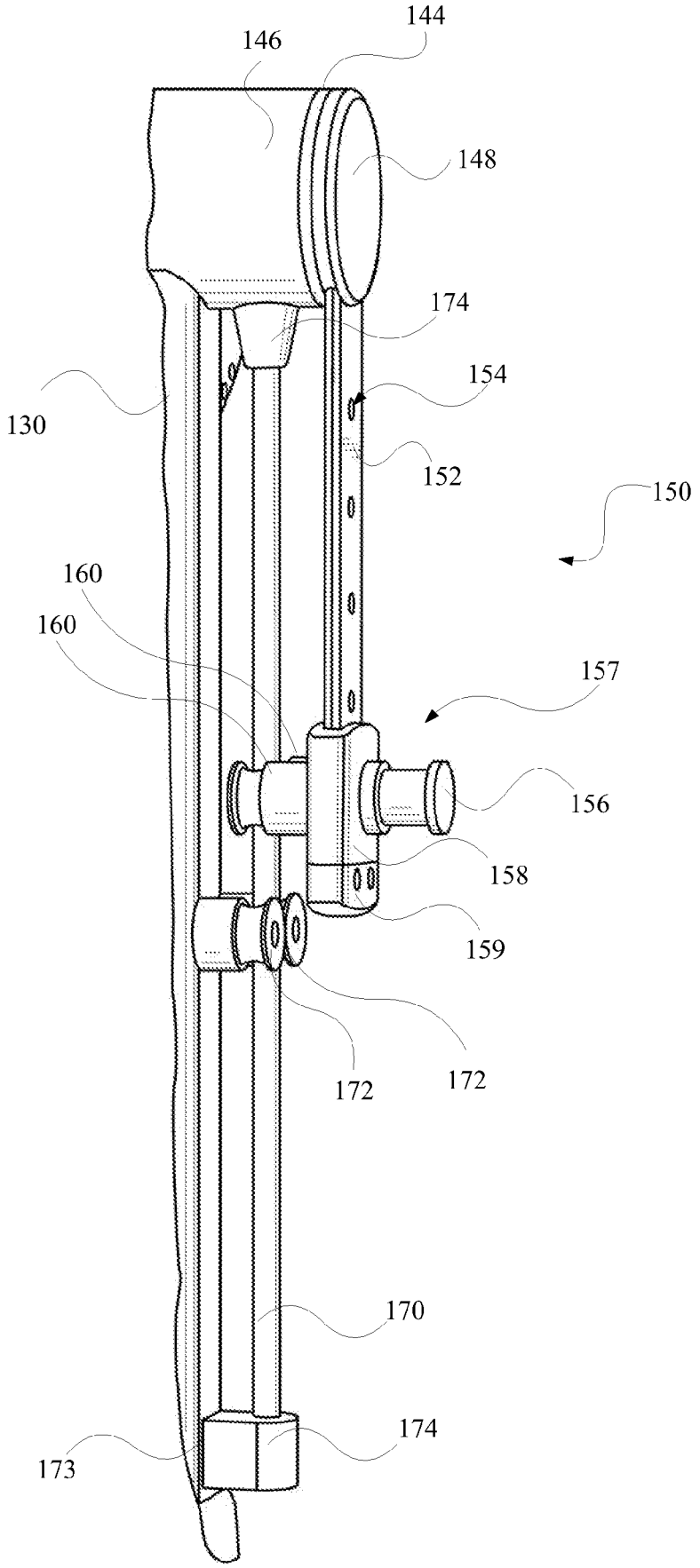
FIG. 6 is a back perspective cutaway view of a resistance system, according to one embodiment.

The actuation member 120 is rotatably coupled through the pivot assembly 140 to the resistance system 150. As shown in FIG. 6, the illustrated resistance system 150 includes a lever cap 148 directly connected to a resistance lever arm 152 that is pivotably connected to the pivot assembly 140. Similar to the lever arm 124 that forms a portion of the actuation member 120, the resistance lever arm 152 is connected to the lever cap 148 such that as the lever cap 148 is rotated, the resistance lever arm also rotates or pivots about a pivot point. As shown, the resistance lever arm 152 has a main body defining a number of adjustment orifices 154 defining a number of attachment points. The resistance lever arm 152 terminates with a lever end 159 that is sized to prevent the unintentional removal of the additional selection features associated with the resistance lever arm. As shown, a resistance engagement member 157 is formed on the resistance lever arm and includes a resistance selection housing 158 that is slideably connected to the resistance lever arm 152 and includes a selection actuator 156 in the form of a knob. According to one embodiment, the selection actuator 156, when pulled, releases a selection pin 700, FIG. 7 that selectively engages the adjustment orifices 154 formed on the resistance lever arm 152 to position the resistance selection housing 158 on the resistance lever arm. According to one embodiment, a plurality of abutment bushings 160 is formed on the resistance selection housing 158 opposite the selection actuator 156. As illustrated, the abutment bushings 160 engage the deflection member 170 that is anchored to the resistance based exercise system 100. According to the embodiment illustrated in FIG. 6, the deflection member 170 is attached on a lower end to the vertical support 130 by a first anchor 174 and is attached on a top end to the pivot housing 146 by a second anchor 174. Additionally, a plurality of optional frame bushings 172 are illustrated as being attached to the vertical support 130 where they may engage the deflection member 170. Further details of the structure and operation of the resistance system 150 will be provided below with reference to FIGS. 7-9.

Figure 7:
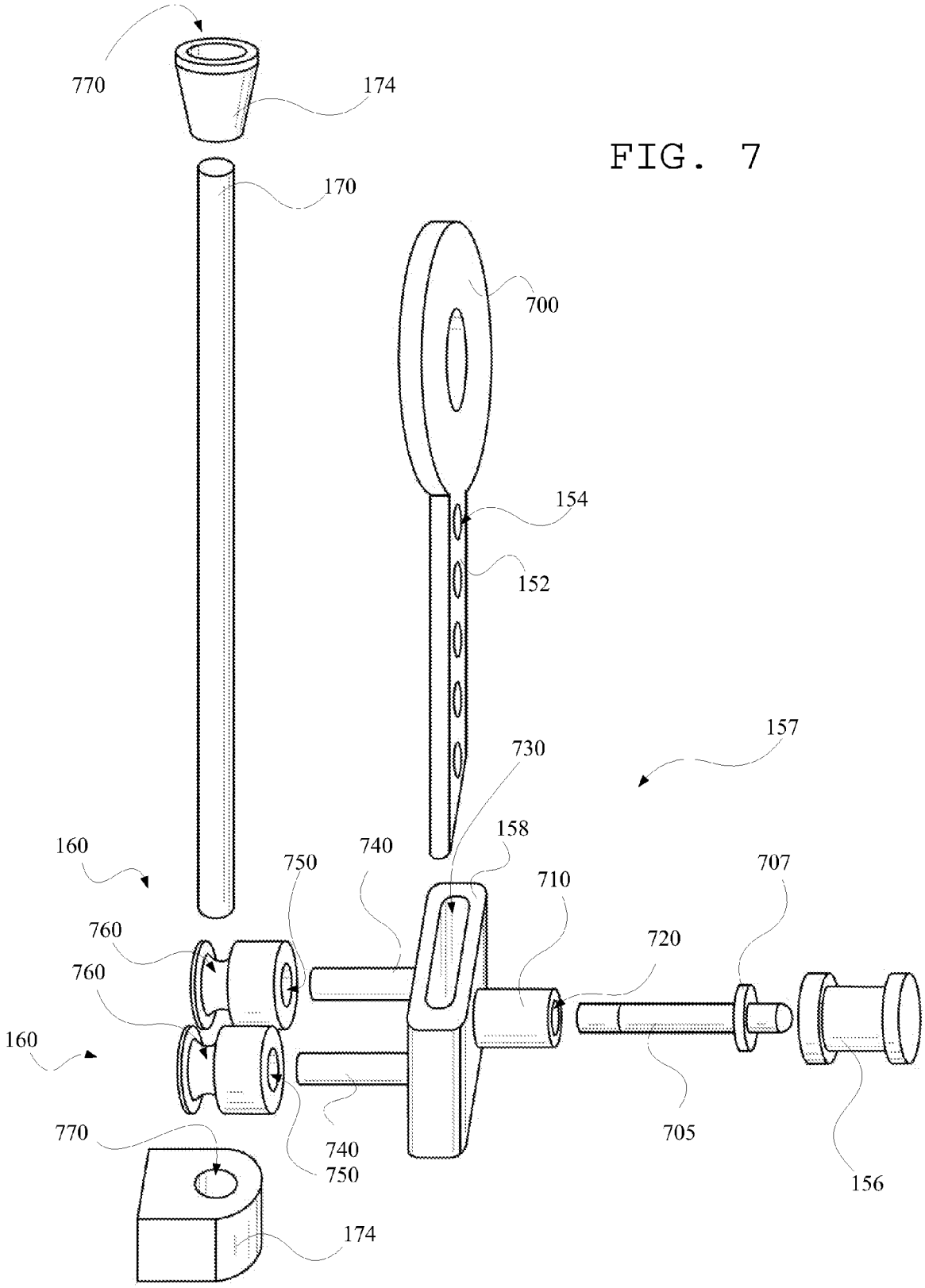
FIG. 7 is frontal exploded side view of a resistance system, according to one embodiment.

FIG. 7 illustrates an exploded view of the resistance system 150, according to one embodiment. As shown, the resistance lever arm 152 includes a main hub 700 that is, along with a resistance lever arm 152, connected to the actuation member 120 to transfer the force input by a user from the actuation member to the resistance lever arm. The resistance lever arm 152, which is pivotably connected to the pivot housing 146, extends from the main hub 700, defining a plurality of adjustment orifices 154, thereby allowing the resistance lever arm to be an indexing lever for purposes of modifying the position of the resistance selection housing 158 relative to the deflection member 170. As shown, the resistance lever arm 152 includes a main body having a somewhat rectangular cross-sectional shape with rounded edges. Additionally, as illustrated in FIG. 7, the lever arm 152 defines a number of adjustment orifices 154 that are sized to selectively receive a selection pin 705, thereby securing the position of the resistance selection housing 158 relative to the resistance lever arm 152 and the adjacent deflection member 170. While the adjustment orifices 154 are illustrated as traversing the front body of the lever arm 152, the adjustment orifices 154 may assume any appropriate orientation. Additionally, while a pin and orifice engagement system is illustrated in FIG. 7, any number of selective adjustment mechanisms may be used to selectively secure the position of the resistance selection housing 158 relative to the resistance lever arm 152 including, but in no way limited to, a ratchet system, a pin system, a gear system, and the like.

Continuing with FIG. 7, the resistance lever arm 152 is sized to be slideably received in the resistance selection housing 158. Specifically, the resistance selection housing 158 includes a main body defining a lever arm reception orifice 730 sized to slideably receive the resistance lever arm 152. The resistance selection housing 158 further includes a selection pin housing 710 formed on a front surface thereof, defining a selection pin orifice 720. As illustrated, the selection pin orifice 720 is sized to receive a selection pin 705 having an insertion stop 707 formed thereon and having a selection actuator attached thereto. According to one embodiment the selection pin 705 is spring loaded inside the selection pin orifice 720 to maintain the selection pin 705 in an engaged position until disengaged by the application of a pulling force on the selection actuator 156 to overcome the position maintaining spring force.

According to the embodiment illustrated in FIG. 7, the lever arm reception orifice 730 is further sized to orient the resistance lever arm 152 within the resistance selection housing 158 such that as the resistance selection housing slides up and down the resistance lever arm 152, the selection pin is aligned with the adjustment orifices 154. As varying positions of the resistance selection housing are desired, a user may pull the selection actuator 156, thereby disengaging the selection pin 705 from the adjustment orifices 154, allowing for the slideable translation of the resistance selection housing 158 along the resistance lever arm 152 until the selection pin 705 is engaged with a desired adjustment orifice, thereby positionally locking the resistance selection housing.

Additionally, a plurality of bushing axels 740 are attached to the back surface of the resistance selection housing 158. As shown, the bushing axels 740 are each configured to receive and secure the abutment bushings 160 by insertion of the bushing axels 740 in the axel reception orifice 750 defined in each abutment bushing. According to one embodiment the bushing axels 740 are secured to the axel reception orifice 750 of the abutment bushings 160 by any fastening system including, but in no way limited to an interference fit, adhesives, mechanical fasteners, and the like. FIG. 7 also illustrates the deflection member channel 760 formed on each of the abutment bushings 160. According to one embodiment, the deflection member channel 760 formed on each of the abutment bushings 160 is sized to engage and seat the deflection member 170 therein. This reduces wear on the deflection member 170 during use. The internal surface of the deflection member channel 760 may have any number of surface finishes including, but in no way limited to, a smooth or a rough surface. According to one embodiment, the deflection member channel 760 may be formed of any number of polymers, metals, or composites including nylon.

FIG. 7 further illustrates the anchors 174 that couple the deflection member 170 to the resistance based exercise system 100. The deflection member 170 and the anchors 174 make up the resistance element of the present system. As illustrated, each of the anchors 174 includes a body that is coupled to the vertical support 130 or the pivot housing 146, respectively. As shown, each of the anchors 174 defines a deflection member reception hole 770 sized to receive the deflection member 170. According to one embodiment, once the deflection member is passed through the deflection member reception hole 770, a knot may be formed in the end thereof to increase the size of the end of the deflection member 170 to maintain its position in the anchor 174 and prevent its passage through the deflection member reception hole 770. Alternatively, a fastener or other flaring member may be attached to the end of the deflection member 170 to positionally fix the deflection member in the anchor 174. While anchors 174 are illustrated as positionally fixing the deflection member 170, any number of fixation systems may be used to fix the deflection member including, but in no way limited to, posts and eyelets, fasteners, adhesives, mouldings, and the like.

The deflection member 170 that forms a resistance component of the resistance based exercise system 100 is shown as having a single cylindrical deflection member. As will be described in further detail below, the deflection member is engaged by the abutment bushings and deflected in a transverse direction to flex or stretch the deflection member 170, relying on the modulus of elasticity exhibited by the deflection member 170 to resist the motion and return the deflection member to its original position when the transverse flexing force is removed. FIG. 7 illustrates a single deflection member 170 providing the resistance to the resistance based exercise system 100. However, any number of deflection members 170 of varying characteristics may be added to the system to selectively modify the available resistance to user motion. Additionally, the while the deflection member 170 of FIG. 7 is illustrated as a having a cylindrical shape, the deflection member may assume any number of geometric shapes. According to one embodiment, the deflection member 170 may be formed of any number of materials exhibiting deflection, and particularly elastic deformation in response to a transverse force including, but in no way limited to plastics, elastomers, metals, fibrous materials, woven materials, composites, and the like. According to one embodiment, the deflection member is an elastomeric member. The elastomeric member may be, but is in no way limited to, latex rubber, natural rubber, styrene-butadiene rubber, isoprene rubber, butadiene rubber, ethylene propylene rubber, butyl rubber, chloroprene rubber, nitrile rubber, silicone rubber, and combinations thereof.

According to the present system, selectively varying the position of the resistance selection housing 158 and the associated abutment bushings 160 relative to the resistance lever arm 152 allows for controllably modifying the resistance experienced by the user during exercise. According to one embodiment, the deflection member 170 substantially follows Hooke's law of elasticity which states:

$$F=-kx$$

That is, the resistive force (F) exerted by a spring or elastic member is equal to the negative of the rate or spring constant (k) multiplied by the displacement (x) of the spring or elastic member.

Figure 8:
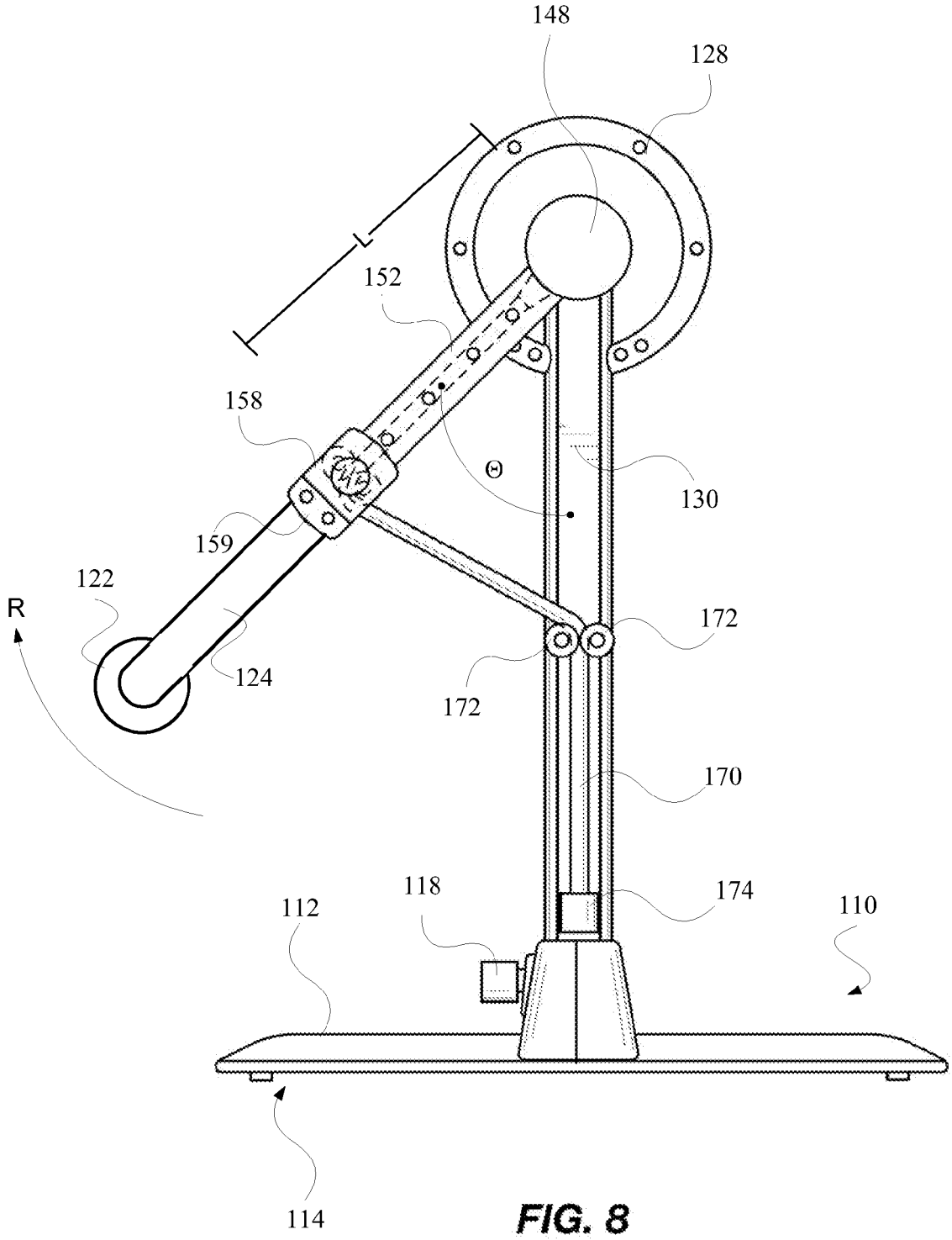
FIG. 8 is a rear view of a resistance based exercise apparatus during operation in a first resistive configuration, according to one embodiment.

As illustrated in FIG. 8, when the resistance selection housing is fixed at the bottom portion of the resistance lever arm 152, an input of force by a user causes rotation R of the resistance lever arm 152 such that the resistance lever arm 152 is rotated an angle θ relative to the vertical support 130. As shown in FIG. 8, in this configuration the deflection member 170 is displaced a relatively large amount and consequently exerts a relatively high resistive force to the user.

Figure 9:
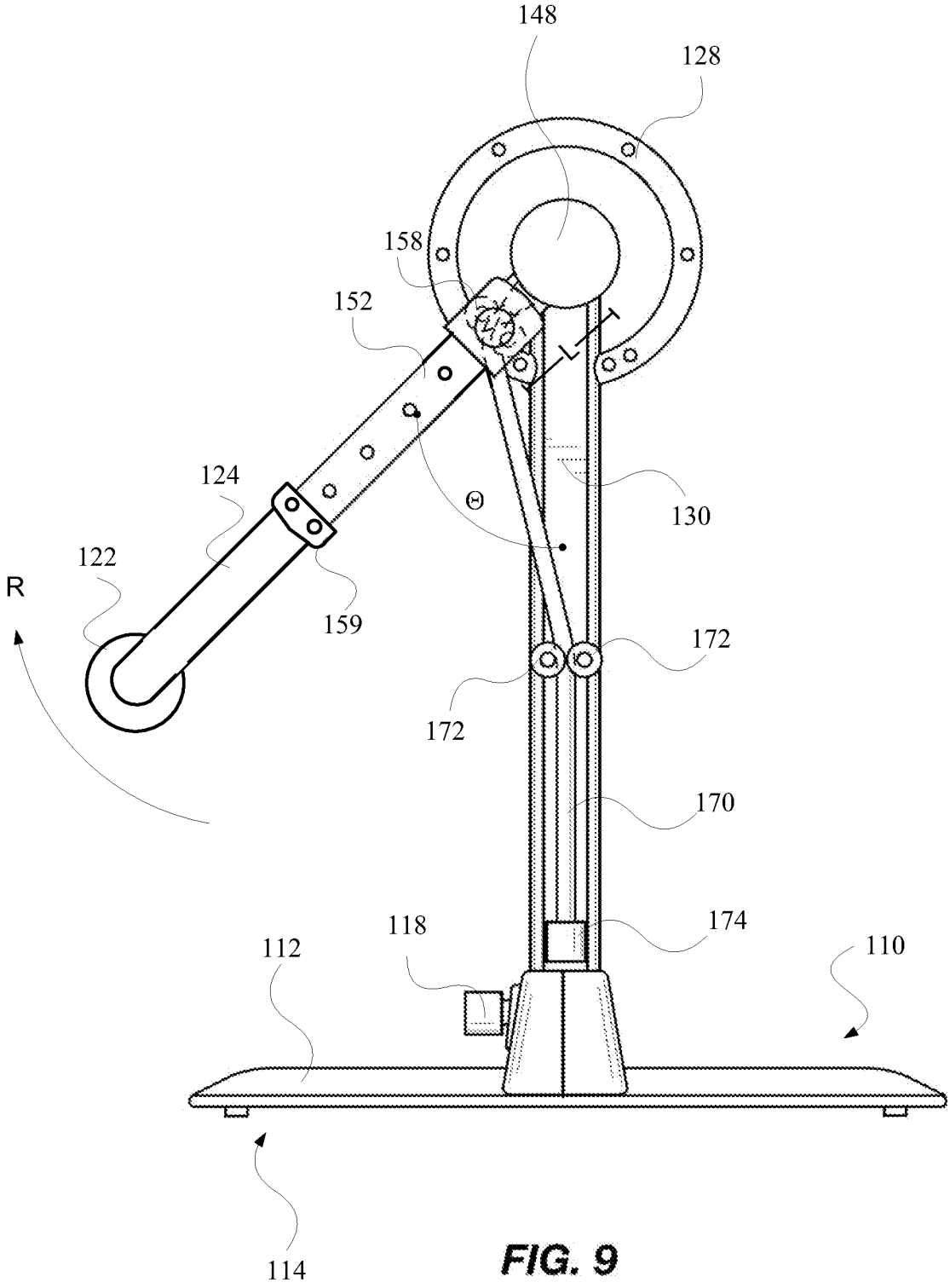
FIG. 9 is a rear view of a resistance based exercise apparatus during operation in a second resistive configuration, according to one embodiment.

In contrast, when the resistance selection housing is fixed at the upper most portion of the resistance lever arm, as illustrated in FIG. 9, an input of force by a user causes the same rotation R of the resistance lever arm 152 such that the resistance lever arm 152 is again rotated to the angle θ relative to the vertical support 130. However, in this configuration the deflection member 170 is transversely displaced a relatively small amount and consequently exerts a relatively small resistive force to the user. The placement of the resistance selection housing 158 relative to the pivot assembly 140 dictates the relative displacement (x) of the deflection member 170, and consequently the resistive force F. For example, the displacement of the abutment bushings 160 is equal to $2L*\pi*\theta$, where L equals the distance from the resistance selection housing 158 relative to the pivot assembly 140, as illustrated in FIGS. 8 and 9.

As illustrated, the adjustment orifices of the resistance lever arm 152 are indexed to selectively position the resistance selection housing 158 from the midpoint of the deflection member 170, to the top of the deflection member. Alternatively, the resistance lever 152 may be configured to allow for placement of the resistance selection housing 158 anywhere relative to the deflection member 170 in order to maximize the potential displacement, and therefore the resistance, of the deflection member.

Alternative Embodiments

Figure 10:
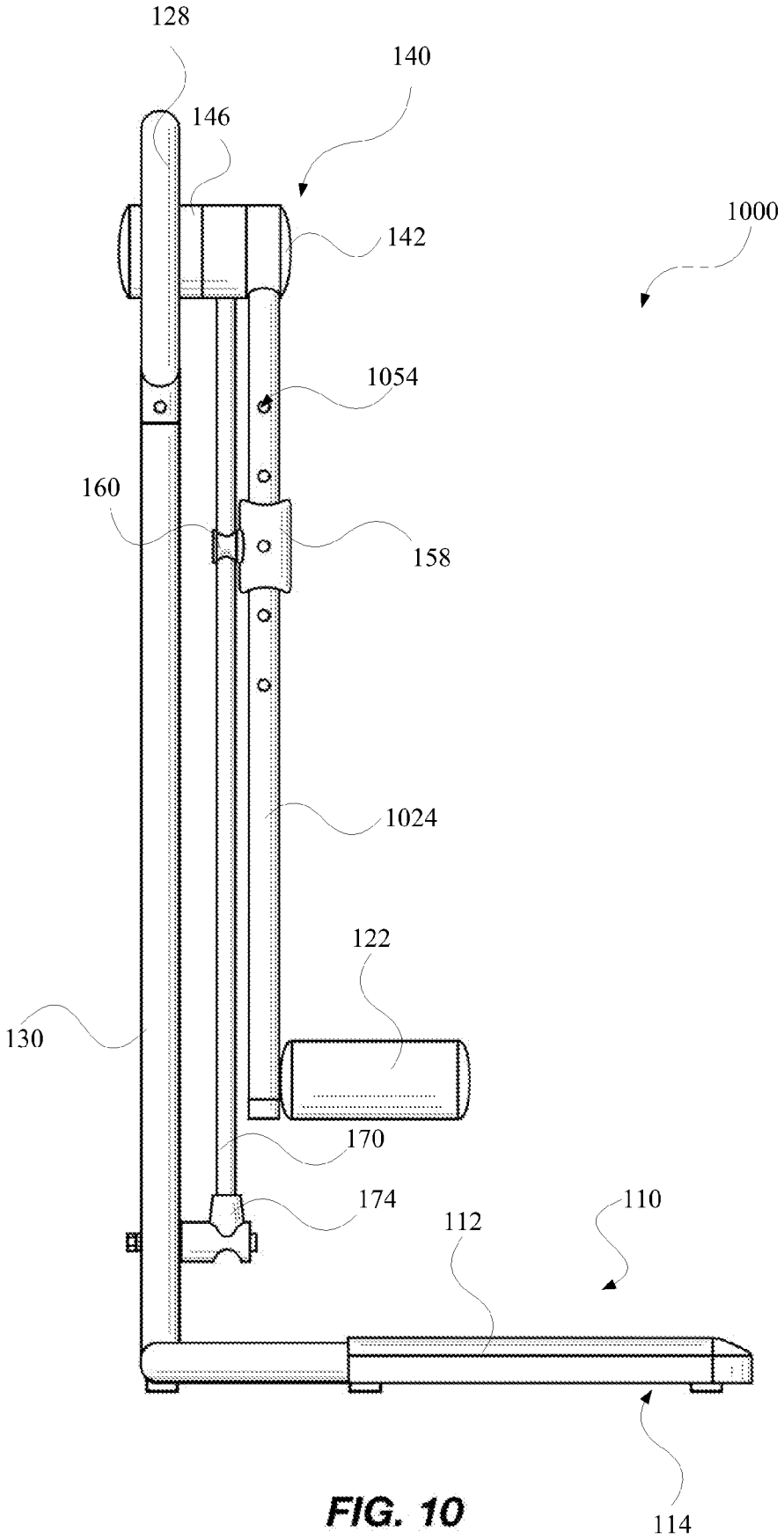
FIG. 10 is a side view of a resistance based exercise apparatus, according to an alternative embodiment.
Figure 11:
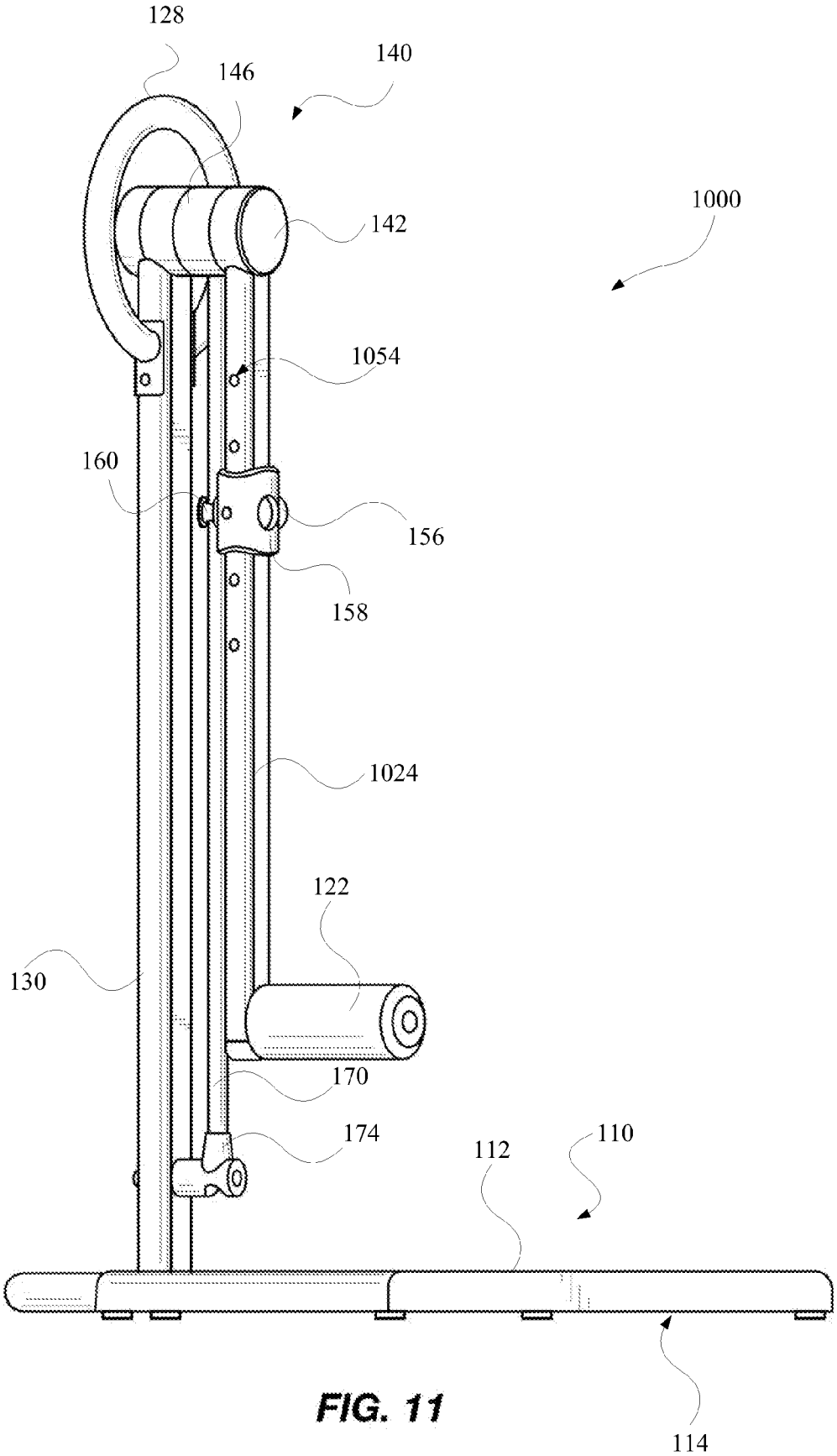
FIG. 11 is a front perspective view of a resistance based exercise apparatus, according to an alternative embodiment.

A number of modifications may be made to the system illustrated in FIGS. 1-9. For example, FIGS. 10 and 11 illustrate a resistance based exercise system 1000 according to one alternative embodiment. The alternative resistance based exercise system 1000 is similar to the embodiment illustrated in FIGS. 1-9 in that it includes a base 110, a vertical support 130, a pivot assembly 140, a support handle 128, a deflection member 170 anchored to the vertical support and the pivot assembly. Additionally, the alternative resistance based exercise system 1000 includes a resistance selection housing 158 with a selection actuator 156 and a plurality of abutment bushings 160. Similarly, as illustrated, the alternative embodiment includes an actuation member 1024 connected to the actuation pivot cap 142 which extends downward parallel to the vertical support 130 and terminating in a user engagement member 122. However, the actuation member 1024 of the alternative embodiment also serves as the lever arm and includes a plurality of adjustment orifices 1054 on the side thereof creating an indexing lever arm to facilitate the selective positioning of the resistance selection housing 158 on the actuation member 1054 relative to the deflection member 170. According to this embodiment, the input of force to the user engagement member 122 causes a rotation of the actuation member 1024, causing the abutment bushings 160 to engage and displace the deflection member, thereby inputting resistance to the rotation of the actuation member 1024. Similar to the embodiment illustrated in FIGS. 1-9, the resistance provided by the deflection member 170 is proportionate to the placement of the resistance selection housing 158 relative to the deflection member and the pivot assembly 140.

Figure 12:
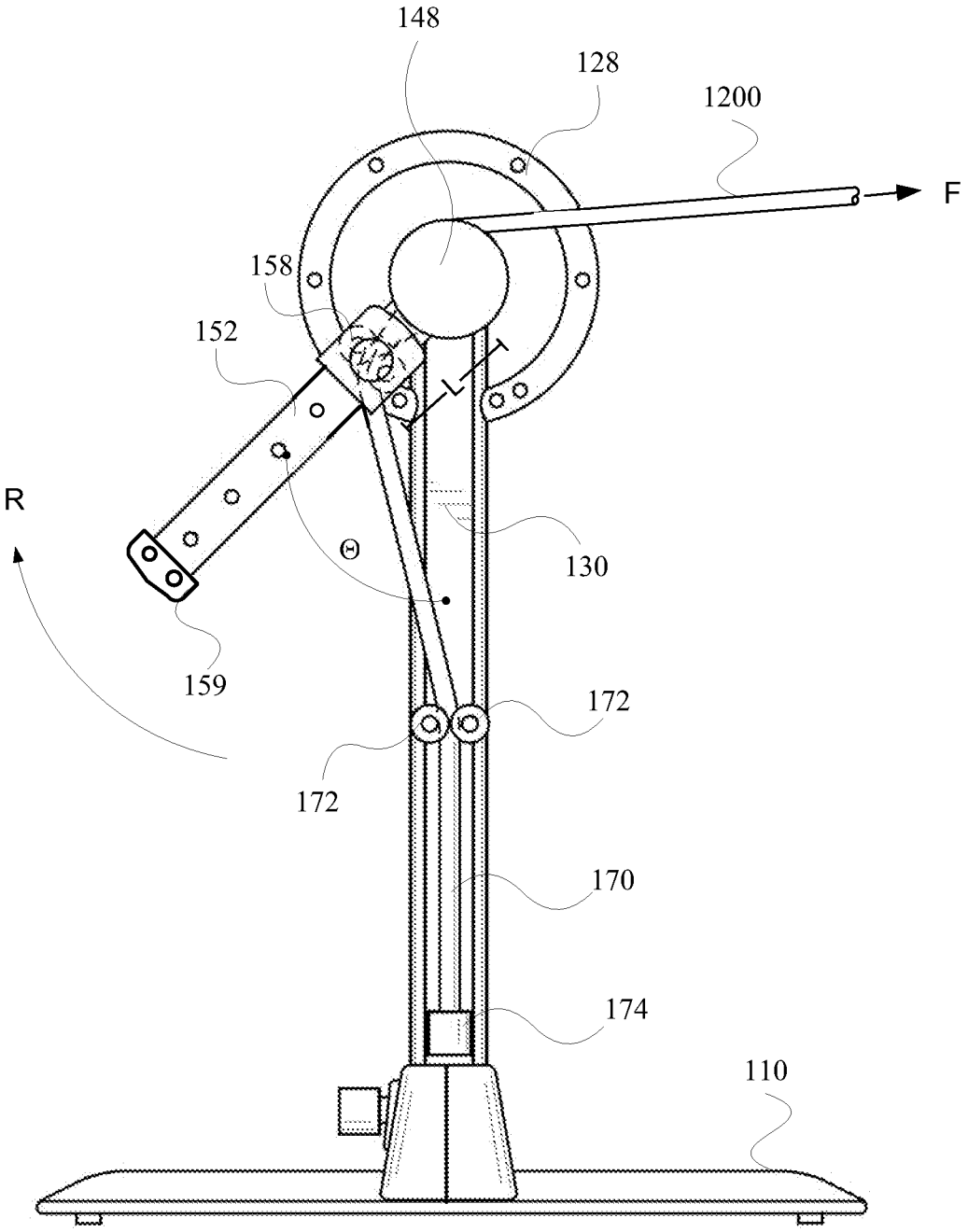
FIG. 12 is a rear view of a resistance based exercise apparatus, according to an alternative embodiment.

While the previous embodiments are illustrated as including an actuation member 120 in the form of a descending bar terminating in a user engagement member 122, any number of actuation members may be used to rotatably actuate the resistance lever arm 152 including, but in no way limited to, a bar, a handle, a cable, a strap, and the like. For example, FIG. 12 illustrates one alternative embodiment of the present resistance based exercise system 100 including a cable 1200 rotatably coupled to the resistance system 150. According to one embodiment an interchangeable coupling device such as a carabineer is attached to the cable 1200 to allow for the coupling of a desired actuation member. According to this embodiment, any exercise imparting a linear force F on the cable 1200, whether it is from a handle, a strap, a bar, or another cable connected to the cable 1200, will rotate the resistance lever arm 152, thereby deflecting the deflection member 170 and introducing a resistive force opposing the input force F.

INDUSTRIAL APPLICABILITY

In general, the structure of the present disclosure provides an apparatus having a relatively small footprint while enabling the performance of numerous resistance based motion exercises. More specifically, the present apparatus leverages the resistive force generated by a single elastic member while adding flexibility by modifying the engagement location of the actuated portions of the structure. This configuration minimizes the size of the system while adding safety and convenience. That is, in contrast with traditional systems that use weight stacks and other resistance systems to provide muscle exercising resistive forces, the present system does not include heavy resistive members that are lifted and, in combination with gravity, provide resistance to the user. Rather, the present system uses one or more deflection members that are selectively and transversely engaged and displaced by an actuated lever arm to create a muscle building and/or toning resistance for the user. By incorporating one or more deflection members that remain coupled to the exercise system, convenience to the user is enhanced. A user no longer needs to add or remove plates or resistive members to modify the resistance experienced.

Additionally, by reducing the number of deflection members used to provide resistance to the user, the cost of the apparatus is reduced when compared to traditional resistance based exercise apparatuses.

Moreover, the present resistance based exercise apparatus provides a wide range of resistive forces in an apparatus having a small footprint. Since, according to one embodiment, the resistance system of the present resistance based exercise apparatus is vertically oriented and the motion of the apparatus is centered on a central pivot assembly, the apparatus may be stored and operated in a relatively small space. Additionally, the small size of the exercise apparatus allows the system to be readily moved in and out of a closet or other storage area.

In the present description, a preferred structure and associated materials are described. However, the present system and method may be practiced with any number of substitute materials and systems. For example, according to one embodiment, while the present system is illustrated as having a single vertical support member 130, any number of additional support members may be implemented for structural and/or functional enhancements. Furthermore, while the vertical support member is illustrated as a linear member protruding linearly from the base extension, the vertical support member may assume any number of orientations or geometries including, but in no way limited to curved or arcuate members.

Similarly, according to the described embodiment, the vertical support member 130 is fabricated of hollow tubing. While the present system is illustrated with the vertical support member being formed of steel tubing having a substantially circular cross-section, the vertical support member may assume any number of cross-sectional configurations to provide the desired structural strength including, but in no way limited to, oval, box, rectangular, I-beam, and the like. Additionally, according to one embodiment, the vertical support member is formed of a metal such as, but in no way limited to, steel, aluminum, and the like. Alternatively, any sufficiently stable material, or combination of materials may be used to form the present vertical support structure including, but in no way limited to, composites, polymers, and the like.

While the support handle is illustrated in the figures as having a circular profile and cross-section, any number of handles or other stabilizing structures, having varied geometries, may be incorporated into the pivot assembly or the vertical support.

Furthermore, according to one embodiment, the actuation member and the resistance lever arm are directly joined through the pivot assembly via an abutment or sleeve, the actuation member and the resistance lever arm may be coupled via any number of mechanisms, intermediate members, or configurations including, but in no way limited to, a gear train that reduces or increases the rotation of the resistance lever arm relative to the input motion imparted on the actuation member. Use of a gear train may be used to increase the available range of motion of the actuation member relative to full rotation of the resistance lever arm and/or to increase the resistance force for small rotations of the actuation member.

While the present system is described as including bushings in the pivot assembly to reduce the friction induced resistance, any number of resistance reduction members may be associated with the pivot housing including, but in no way limited to bearings, grease, sacrificial members, graphite, and the like.

According to one embodiment detailed above, the user engagement member may include padding such as a foam including, but in no way limited to, an open cell foam, a closed cell foam, a polyurethane foam, high density foam, evlon, high resilience foam, latex rubber foam, supreem foam, rebond foam, memory foam, dry fast foam, neoprene foam, viscoelastic polymer gel, and the like. Alternatively, depending on how the user engagement member is to be engaged, the user engagement member may include a knurled or any other surface finish to enhance the surface of the user engagement member.

While the lever arm is illustrated and described above as being substantially rectangular, the lever arm may assume any number of cross-sectional shapes including, but in no way limited to, oval, circular, quadratic, triangular, and the like. Furthermore, the lever arm may be formed of any number of materials and/or processes that produce a structurally sound member. Specifically, according to one embodiment, the lever arm may be formed of metal, plastic, wood, composite, and the like.

While the present system is described as having a rotationally actuated lever arm with a user engagement member as the force input member, any number of force input members may be used with the present resistance system including, but in no way limited to, pulleys, cables, bars and the like. Additionally, the present resistance based exercise system is described as having a 1:1 rotation ratio between the actuation member and the resistance lever arm of the resistance system. However, any number of gear reduction systems or transmissions may be used with the present resistance system to enable a desired exercise motion and resistive effect.

In conclusion, the present system and method provides a compact exercise system that enables the performance of multiple exercises with varying levels of resistance, without the inconvenience of changing weights or bands. More specifically, the present system leverages the varying resistive characteristics of a single deflection member to facilitate the performance of multiple exercises while minimizing the size and weight of the exercise system.

What is claimed is:

1. An exercise apparatus, comprising:

a frame;

a resistance lever pivotably attached to the frame;

a deflection member having a first end fixed relative to the frame and a second end fixed relative to the frame;

a resistance engagement member moveably attached to said resistance lever, the resistance engagement member sized and configured to transversely engage and flex the deflection member when a force is input into the resistance lever; and wherein a resistance provided by the deflection member is adjustable by positionally adjusting the resistance engagement member on the resistance lever.

2. The exercise apparatus of claim 1, wherein said frame comprises a base and at least one vertical support member attached to the base.

3. The exercise apparatus of claim 2, wherein said first end and said second end of the deflection member are each connected to the at least one vertical support member.

4. The exercise apparatus of claim 2, further comprising a pivot assembly attached to the at least one vertical support member.

5. The exercise apparatus of claim 4, wherein the first end of the deflection member is attached to said pivot assembly and said second end of the deflection member is attached to said at least one vertical support member.

6. The exercise apparatus of claim 1, further comprising a user engagement member disposed on said resistance lever.

7. The exercise apparatus of claim 1, wherein the resistance engagement member includes a plurality of attachment points wherein said plurality of attachment points are configured to selectively position said resistance engagement member between said first end and a midpoint of said deflection member.

8. The exercise apparatus of claim 1, further comprising an input actuation member fixed to said resistance lever.

9. The exercise apparatus of claim 8, wherein said input actuation member comprises:

an input lever arm having a first end and a second end, a first end of said input lever arm is fixed to said resistance lever; and a user engagement member disposed on said second end of said input lever arm.

10. The exercise apparatus of claim 8, wherein said input actuation member comprises a cable.

11. The exercise apparatus of claim 1, wherein said deflection member comprises an elastomer.

12. The exercise apparatus of claim 11, wherein said elastomer comprises a latex rubber.

13. The exercise apparatus of claim 11, wherein said elastomer comprises at least one of a natural rubber, a styrene-butadiene rubber, an isoprene rubber, a butadiene rubber, an ethylene propylene rubber, a butyl rubber, a chloroprene rubber, a nitrile rubber, and a silicone rubber.

14. The exercise apparatus of claim 1, wherein said resistance engagement member includes a selection pin; and wherein said resistance lever defines a plurality of orifices, each orifice of the plurality of orifices configured to receive said selection pin and positionally secure said resistance engagement member on said resistance lever.

15. The exercise apparatus of claim 1, wherein said resistance engagement member further comprises at least one abutment bushing disposed adjacent to said deflection member.

16. The exercise apparatus of claim 15, wherein said resistance engagement member further comprises a first abutment bushing and a second abutment bushing; and wherein said deflection member is disposed between said first abutment bushing and said second abutment bushing.

17. The exercise apparatus of claim 1, wherein said resistance engagement member is configured to be moved between at least a first position and a second position on said resistance lever;

wherein said resistance engagement member positioned in said first position deflects said deflection member a first amount in a direction substantially transverse to an axis of said deflection member in response to an angular rotation of said resistance lever; and wherein said adjustable engagement member positioned in said second position deflects said deflection member a second amount in the direction substantially transverse to the axis of said deflection member in response to said angular rotation of said resistance lever.

18. An exercise apparatus, comprising:

a frame including a base and at least one vertical support member attached to the base;

a resistance lever pivotably attached to the frame;

an input actuation member connected to said resistance lever;

a resistance engagement member moveably attached to said resistance lever, the resistance engagement member including at least one abutment bushing, said resistance engagement member being positionable at a plurality of attachment points on the resistance lever, wherein said resistance engagement member includes a selection pin; and a resistance element disposed adjacent to said resistance engagement member, said resistance element including an elastomer deflection member having a first end and a second end, a first anchor attached to and positionally fixing said first end of said deflection member, and a second anchor attached to and positionally fixing said second end of said deflection member, wherein said first anchor and said second anchor are each connected to the at least one vertical support member;

wherein said resistance lever defines a plurality of orifices to receive said selection pin and positionally secure said resistance engagement member on said resistance lever;

wherein said resistance lever is configured to pivot about said pivot point when a force is input to said resistance lever, and said resistance engagement member is configured to transversely engage said deflection member when a force is input to said resistance lever; and wherein a resistance provided by the resistance element is adjustable by positionally adjusting the resistance engagement member along said attachment points.

19. The exercise apparatus of claim 18, wherein said frame further comprises a pivot assembly attached to the at least one vertical support member;

wherein said resistance lever is pivotably connected to said pivot assembly and said input actuation member is connected to said resistance lever via said pivot assembly;

wherein the first anchor is attached to said pivot assembly and said second anchor is attached to said at least one vertical support member;

wherein said resistance engagement member further comprises a first abutment bushing and a second abutment bushing; and wherein said deflection member is disposed between said first abutment bushing and second abutment bushing.

20. An exercise apparatus, comprising:

a frame including a base, at least one vertical support member attached to the base, and a pivot assembly attached to said at least one vertical support member;

a resistance lever pivotably attached to the frame;

an input actuation member connected to said resistance lever;

a resistance engagement member moveably attached to said resistance lever, said resistance engagement member being positionable at a plurality of attachment points on the resistance lever, and wherein said resistance engagement member includes a selection pin; and a resistance element disposed adjacent to said resistance engagement member, said resistance element including an elastomer deflection member having a first end and a second end, a first anchor attached to and positionally fixing said first end of said deflection member, and a second anchor attached to and positionally fixing said second end of said deflection member, and wherein said first anchor and said second anchor are each connected to the at least one vertical support member;

wherein said resistance lever defines a plurality of orifices configured to receive said selection pin and positionally secure said resistance engagement member on said resistance lever;

wherein said resistance engagement member includes a first abutment bushing and a second abutment bushing, said deflection member being disposed between said first abutment bushing and second abutment bushing;

wherein said resistance lever is configured to pivot about said pivot point when a force is input to said resistance lever, and said resistance engagement member is configured to transversely engage said deflection member when a force is input to said resistance lever;

wherein a resistance provided by the resistance element is adjustable by positionally adjusting the resistance engagement member along said attachment points;

wherein said resistance engagement member is configured to have at least a first position and a second position on said resistance lever relative to said first and second anchors;

wherein said resistance engagement member positioned in said first position deflects said deflection member a first amount in a direction substantially transverse to an axis of said deflection member in response to an angular rotation of said resistance lever; and wherein said adjustable engagement member positioned in said second position deflects said deflection member a second amount in a direction substantially transverse to the axis of said deflection member in response to said angular rotation of said resistance lever.

* * * * *